United States Patent [19]

Vasiliev et al.

[11] 4,418,749

[45] Dec. 6, 1983

[54] HEAT EXCHANGER

[75] Inventors: Boris P. Vasiliev; Nikolai L. Borisov; Mikhail K. Semenov; Ivan K. Ponomarev; Galina B. Tyryshkina; Igor V. Gorbatenko, all of Belgorod, U.S.S.R.

[73] Assignee: Belgorodsky Zavod Energeticheskogo Mashinostroenia, U.S.S.R.

[21] Appl. No.: 316,877

[22] Filed: Oct. 30, 1981

[51] Int. Cl.[3] ..... F28F 7/00

[52] U.S. Cl. ..... 165/139; 165/145; 165/DIG. 27

[58] Field of Search ..... 165/160, 139, 157, 165, 165/DIG. 27, 134 R; 432/82, 83

[56] References Cited

U.S. PATENT DOCUMENTS 2,750,159 6/1956 Ebner ..... 165/103

3,483,920 12/1969 Heyn et al. ..... 165/157

*Primary Examiner*—William R. Cline

*Assistant Examiner*—John F. McNally

*Attorney, Agent, or Firm*—Steinberg & Raskin

[57] ABSTRACT

In a heat exchanger for the recovery of heat from hot shale ashes, having tubes arranged in a frame in latticed pattern and serving to conduct a gas, the frame is surrounded by a housing wherein the space enclosed by the frame and the housing is divided into a collector and a distribution chamber. The shale ashes move through the heat exchanger transversely of the longitudinal direction of the tubes. At the inlet for shale ashes there is provided an inlet space divided with a vertical partition wall into unequal compartments for receiving the ashes incoming through separate inlets under different pressures.

1 Claim, 2 Drawing Figures

HEAT EXCHANGER

BACKGROUND OF THE INVENTION

1. Field of the Invention

The present invention relates to heat exchangers and particularly to a heat exchanger for the recovery of heat from shale ashes in a process for the continuous retorting of oil shale, the ashes incoming as at least two flows under different pressures, the heat exchanger having tubes arranged in a space latticed pattern and serving to conduct the medium that is to be heated or cooled, the ends of the tubes being held in side walls of a frame wherethrough the shale ashes move vertically to the longitudinal direction of the tubes.

2. Description of the Prior Art

A heat exchanger closely bearing on the invention is disclosed in U.S. Pat. No. 3,483,920. The heat exchanger comprises tubes arranged in at least two horizontal side-by-side planes and serving to conduct a fluid for heat exchange. The tubes in one plane are transverse to those of the other plane. The tubes are held at their ends in the side walls of a frame open at two sides transverse to the side walls to form an inlet and outlet for hot shale ashes. The frame is surrounded by a housing having an inlet and outlet, the housing engaging the frame to form with the housing inlet and outlet a flow path for the fluid through the tubes in the side-by-side planes.

The prior-art heat exchanger may be used for cooling shale ashes incoming in one flow as a vertically moving bed. In the case of picking up shale ashes in two stages of a shale retorting system wherein each stage is characterized by different parameters, particularly pressure, a separate exchanger is required for each stage or ashes flow.

SUMMARY OF THE INVENTION

An object of the present invention is to provide a heat exchanger ensuring a reliable and efficient operation with two flows of hot shale ashes under different pressures incoming to the heat exchanger.

These and other objects of the invention, which will become apparent from the following description, are attained in a heat exchanger of the class described comprising tubes arranged in at least two horizontal side-by-side planes and serving to conduct a fluid for heat exchange, the tubes in one plane being transverse to those of the other plane, said tubes being held at their ends in the side walls of an elongate upright frame open at two sides transverse to the side walls to form an inlet and outlet for hot shale ashes, and a housing surrounding said frame and having an inlet and outlet, the housing engaging the frame to form with the housing inlet and outlet a flow path for said fluid through the plurality of tubes in said side-by-side planes, the invention consists in that the side walls of the frame have portions extending above the tubes in the upper one of said at least two horizontal side-by-side planes and together with the upper portion of the housing defining an inlet space, the upper portion of the housing, having at least two inlets for hot shale ashes incoming under different pressures, and at least one partition plate is attached to the upper portion of the housing between the inlets for hot shale ashes and extends downwardly thereby providing at least two compartments each having a cross-sectional area in proportion to the amount of shale ashes incoming through the inlets, the partition plate extending downwardly for an amount sufficient to equalize pressure in the adjacent compartments.

The partition plate in the inlet space, whereto granular material (hot shale ashes) is fed to further vertically move as a compact bed, provides for a desired operability and reliability of the heat exchanger utilized in a shale retorting system consisting of two or more stages. In such processing systems the picked up ashes are characterized by dissimilar parameters and from the first stage ashes are yielded in greater amounts and at higher pressure than from the second. To eliminate an unfavourable effect of pressure in one compartment of the inlet space on the inflow of ashes into an adjacent one the partition plate is designed so as to have such a length or deepening into the ashes that the maximum difference in pressure between the adjacent two stages does not disturb the exchanger operation or, in other words, that pressure in adjacent compartments is equalized at such a depth where one flow of ashes does not obstruct the other.

In such a heat exchanger a steady inflow of hot shale ashes is ensured and conditions for a further uniform movement of the shale ashes as a compact bed are established.

BRIEF DESCRIPTION OF THE DRAWINGS

Now the invention is described, by way of example, with reference to the accompanying drawings wherein.

DESCRIPTION OF THE PREFERRED EMBODIMENT

Figure 1:
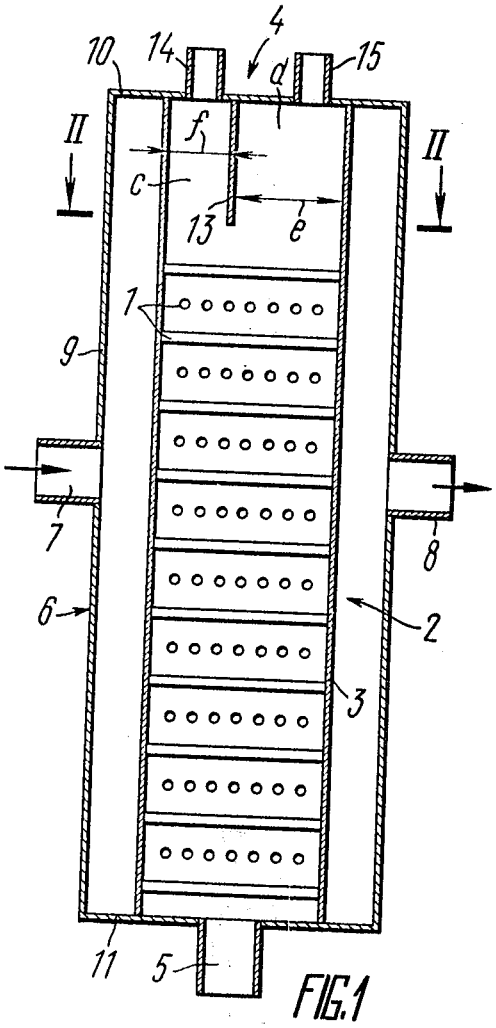
FIG. 1 is a diagrammatical view of the heat exchanger of the invention.

Referring to FIG. 1, a heat exchanger comprises tubes 1 for conducting at least one fluid, e.g. air, for heat exchange. The tubes 1 are arranged in side-by-side planes so that the tubes in one plane are transverse to those of the other plane. The tubes are arranged parallel in each plane and in adjacent planes they are at right angles to one another thus forming rows positioned one above the other in a space latticed structure. The ends of the tubes 1 are held in a frame 2, and more precisely, in its side walls 3. The frame 2 is an elongated tubular structure open at two sides to form an inlet 4 and an outlet 5 for hot shale ashes. The frame 2 is arranged at right angles to the horizontal, though it may be arranged at any other angle, provided the shale ashes flow is not disturbed, and it may be round, oval, rectangular or of any other suitable shape in cross section, presently being square-shaped.

The frame 2 is enclosed by a housing 6 having an inlet 7 and an outlet 8 for air. The housing 6, as illustrated herein, is of a round cross section (FIG. 2), i.e., it is a cylinder having side wall 9 and two end walls: and upper end wall 10 and a lower end wall 11. The diametrically opposed longitudinal edges of the frame 2 are engaged with the side wall 9 of the housing 6 by means of sealing partitions 12, which may be of any known type and therefore are not shown in the drawings. The space defined by the walls of the housing 6 and of the frame 2 is divided therefore into a collector chamber a and a distribution chamber b, which chambers together with the inlet 7 and the outlet 8 as well as with the tubes 1 forming a flow path for air.

Figure 2:
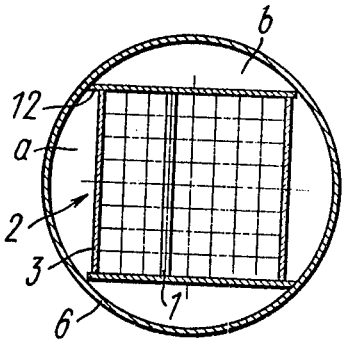
FIG. 2 is a cross-sectional view taken on the line 2—2 in FIG. 1.

As can be seen in FIG. 1, between the tubes 1 of the upper row and the upper portion of the wall of the housing 6, i.e., the upper end wall 10 as well as side walls 3 there is provided an inlet space consisting of compartments c and d further defined by a partition plate 13 attached to the underside of the upper end wall 10. The same wall has inlets 14 and 15 for hot shale ashes inflowing from different stages of the shale retorting system and into the compartments c and d. The partition plate 13 shown in FIG. 1 is extending downwardly to the extent to be designed for each heat exchanger with regard to the pressure in the inflowing ashes. Also, the compartments c and d each have a cross-sectional area in proportion to the amount of shale ashes inflowing thereto through the inlets 14 and 15 (FIGS. 1 and 2).

In operation, the shale ashes carried by gases under different superatmospheric pressures flow through the inlets 14 and 15 into the heat exchanger. For instance, through the inlet 15 the ashes inflow is under a higher superatmospheric pressure than through the inlet 14. To start the operation of the heat exchanger the ashes are accumulated in the frame 2 by letting them pass through either one of the inlets 14 or 15, e.g. that designated by the numeral 15. The ashes having been accumulated somewhat above the level of the lower extremity of the partition plate 13 in one compartment, e.g. designated d, the feed is through the other inlet. As a result of pressure difference between the compartments c and d the levels of accumulating ashes in the adjacent compartments grow non-uniformly, for example as shown at e and f and the difference in the height of accumulated columns of the ashes as a function of weight equalizes the superatmospheric pressures of the transporting gases. Following this equalization of pressures the ashes are let to move out of the frame 2 through the outlet 5 whereby they pass over the tubes 1 to heat the air conducted through the same tubes. The levels e and f are continuously maintained due to an unhampered and proportional inflow of the ashes through the inlets 14 and 15 thereby forming a uniform vertically moving compact bed of the ashes below these levels.

What is claimed is:

1. In a heat exchanger for the recovery of heat from shale ashes in a process for the continuous retorting of oil shale, the ashes incoming as at least two flows under different pressures, having a plurality of tubes arranged in at least two horizontal side-by-side planes and serving to conduct a fluid for heat exchange, the tubes in one plane being transverse to those of the other plane, said tubes being held at their ends in the side walls of a frame open at two sides transverse to the side walls to form an inlet and outlet for hot shale ashes, and a housing surrounding said frame and having an inlet and outlet, said housing engaging the frame to form with the housing inlet and outlet a flow path for said fluid through the plurality of tubes in said side-by-side planes the improvement which comprises the side walls of said frame, having portions extending above the tubes in the upper one of said at least two horizontal side-by-side planes and up to the upper portion of said housing, which upper portion having at least two inlets for hot shale ashes, and defining an inlet space, at least one partition plate attached to the upper portion of said housing between said inlets for hot shale ashes and extending downwardly, thereby providing at least two compartments each having a cross-sectional area in proportion to the amount of shale ashes incoming through said inlets, said partition plae extending downwardly for an amount sufficient to equalize pressure in the adjacent compartments.

* * * * *